United States Patent [19]

Leibee

[11] 4,371,210

[45] Feb. 1, 1983

[54] FREELY ROTATABLE PICK BIT HOLDER ON ROTARY DRIVEN MEMBER AND METHOD

[75] Inventor: Donald L. Leibee, Bedford, Pa.

[73] Assignee: Kennametal Inc., Latrobe, Pa.

[21] Appl. No.: 269,553

[22] Filed: Jun. 2, 1981

Related U.S. Application Data

[63] Continuation of Ser. No. 61,190, Jul. 27, 1979, abandoned, which is a continuation of Ser. No. 894,736, Apr. 10, 1978, abandoned.

[51] Int. Cl.[3] ..... E21C 27/24; E21C 35/18

[52] U.S. Cl. ..... 299/10; 299/86; 175/338; 175/354

[58] Field of Search ..... 299/10, 39, 40, 86; 175/338, 354, 374, 375

[56] References Cited

U.S. PATENT DOCUMENTS

| | | | |
|---|---|---|---|
| 2,207,187 | 7/1940 | Zublin | 175/338 X |
| 2,668,039 | 2/1954 | Cartlidge | 299/86 X |
| 3,343,883 | 9/1967 | Whittaker | 299/89 |
| 3,409,331 | 11/1968 | Krekeler | 299/86 X |
| 3,519,309 | 7/1970 | Engle et al. | 175/354 X |
| 3,645,579 | 2/1972 | Marcovitch | 299/86 X |
| 3,695,723 | 7/1970 | Kita et al. | 299/86 X |
| 3,749,448 | 7/1973 | Taylor | 299/86 X |
| 3,967,854 | 7/1976 | Posciri | 299/86 X |
| 4,057,294 | 11/1977 | Krekeler | 299/93 |
| 4,080,000 | 3/1978 | Paurat | 299/87 X |

FOREIGN PATENT DOCUMENTS

| | | |
|---|---|---|
| 18734 | of 1929 | Australia . |
| 26769 | of 1929 | Australia . |
| 288984 | 5/1915 | Fed. Rep. of Germany . |
| 2029846 | 12/1971 | Fed. Rep. of Germany . |
| 2038345 | 2/1972 | Fed. Rep. of Germany . |
| 1277727 | 6/1972 | United Kingdom . |
| 1303718 | 1/1973 | United Kingdom . |
| 1315295 | 5/1973 | United Kingdom . |
| 1347504 | 2/1974 | United Kingdom . |
| 1391440 | 4/1975 | United Kingdom . |
| 1418754 | 12/1975 | United Kingdom . |
| 1433539 | 4/1976 | United Kingdom . |
| 1470490 | 4/1977 | United Kingdom . |
| 1481198 | 7/1977 | United Kingdom . |

*Primary Examiner*—Ernest R. Purser

*Attorney, Agent, or Firm*—Lawrence R. Burns; Ira D. Blecker

[57] ABSTRACT

Disclosed herein is a new method and improved apparatus for digging and mining earth formations, especially coal formations. A mining or excavating machine having a movable frame with a drive means mounted on the frame is provided with a rotatable structural member and a rotatable cutter support having cutter bits mounted thereon. The structural member is rotatably mounted on the frame and connected to the drive means so as to be driven in one direction of rotation about a longitudinal axis of the structural member. The rotatable cutter support assembly with the cutter bits mounted thereon is rotatably mounted on the structural member and is freely rotatable about its longitudinal axis. The mining machine is then positioned so that the cutter bits will reduce the mineral formation by driving the structural member in one direction of rotation about its longitudinal axis. Engagement of the mineral formation with the cutter bits then causes the freely rotatable cutter support to rotate about its longitudinal axis in a direction that is reverse to that of the power driven structural member. This method of mining mineral formations, especially coal, allows the type cutter bits commonly used to penetrate and fracture the mineral formations without undue and unnecessary frictional engagement, eliminating unnecessary dust and sparks.

A new type cutter bit is also disclosed herein for use with the apparatus.

9 Claims, 11 Drawing Figures

FREELY ROTATABLE PICK BIT HOLDER ON ROTARY DRIVEN MEMBER AND METHOD

This is a continuation, of application Ser. No. 061,190, filed July 27, 1979, which was a continuation of application Ser. No. 894,736, filed Apr. 10, 1978, now both abandoned.

BACKGROUND OF THE INVENTION

This invention has utility in the excavating field and, most particularly, in the mining of coal formations.

More specifically, it is believed the invention will be especially useful when the method is used in conjunction with the type of cutter bits currently in use in the coal mining field and with the new type bit disclosed herein, and it is believed it will be a useful advance in the design of the machines used to reduce coal formations and, also, will be a useful advance in the methods used to reduce coal formations.

New methods and new machines are contemplated by the present invention.

By way of example, it is believed the invention can be used where point attack type cutter bits are now used in coal mining, especially when such point attack type cutter bits are being power driven through the formation being reduced, such as in coal mines.

Various types of machines have been and are known in the art for digging and reducing earth formations and, also, for the mining of minerals, such as coal and other deposits.

Machines predominantly used in the earth boring art are generally exemplified by those in use for oil well drilling and which generally comprise multiple cone type rollers, where conically shaped roller cones have blunt or dome shaped carbide compacts imbedded in their outer periphery.

The conically shaped roller cutters are mounted on convergent shafts on a frame on the lower end of the drill string and rotation of the drill string causes the rolling cutters to rotate and the compacts to hammer the bottom of the hole and fracture the material. Such machines are more fully described and best exemplified by U.S. Pat. Nos. 2,774,570 and 2,687,875.

Also, in the earth boring field, there are other machines known as tunnel boring machines or raise boring machines which utilize cylindrical rolling cutters which also have blunt carbide compacts imbedded in the cutters' outer periphery. These tunnel boring machines have cutters that are mounted upon a frame located on the lower end of a drill string, and rotation of the drill string while holding the cutters against the formation to be reduced will cause the cutters to rotate and the carbide compacts will impact and fracture the earth formation. These machines are more fully described, and may be exemplified by, U.S. Pat. Nos. 3,797,592, 3,734,213 and 3,679,009.

The machines presently in use for reducing coal formations generally are comprised of power driven rotary drums having cutter bits fixedly mounted on the periphery of each drum. In order to reduce and fracture the coal formation, the drum, and with it the cutter bits, are rotated under power and driven through the formation of coal, thereby fracturing the coal formation by both impact of the bit and friction of the bit as it is driven on through the formation.

Once the drum has been power driven through the formation, the coal falls to the floor of the mine under the machine and is, usually, scooped into a conveyor which will then remove the coal from the area.

In general, it has been found that the cutter bits used on such a drum are, preferably, the individually rotatable pick type bits which are comprised of a hard wear resistant point at the foremost end of the bit, such as a carbide point that initially impacts and fractures the coal seam. These point attack type cutter bits are used extensively in the mining and earth digging art and find particular application to the mining of coal formations. Such cutter bits are described in greater detail and best exemplified by U.S. Pat. Nos. 3,841,708, 3,854,056, 3,605,565, 3,519,309 and 3,499,685.

The desirable feature of these types of cutter bits is that they are held rotatably in a support block with the support block usually being mounted upon a power driven rotary drum or disc. When the bits rotate freely about their longitudinal axis in the holder, a self-sharpening effect occurs on the bit when engaged with the earth formations, and especially when used on coal formations.

The above-mentioned cutter bits are usually mounted so that the tips of the bits fracture the coal seam because of the initial impact and penetration of the carbide point and also continue to cut with a scraping action. There are, however, some drawbacks when using the cutter bits in that the cutting edges of the hardened tips are extremely brittle with the result that the tips frequently break off, particularly when the cutter is reversed or when encountering hard inclusions in a coal seam.

Further, when mining coal with currently known methods, the friction of dragging the bits through the slightly fractured or the unfractured formation increases the horsepower requirements of the machine and wears away the parent material of the steel bit surrounding and holding the carbide point. Further, the friction created by forcing the bits through the unfractured formations creates a severe amount of dust in the working area which creates unhealthy and hazardous working conditions within the coal mine.

With the presently known machines used in coal mining, and with the cutter bits presently known, there is a further danger that sparks created by the steel bits engaging in the coal seam could possibly cause an explosion of any mixture of dust and/or methane gas that may be in existence in the working area.

It is an object of the present invention to present a new and more efficient method of reducing earth formations, especially coal formations.

It is an object of the present invention to present new and improved machines for reducing earth formations, especially coal formations.

It is an object of the present invention to possibly reduce the horsepower requirements per ton of coal necessarily expended from an excavating machine, and especially from a coal mining machine.

It is a further object of the present invention to provide an apparatus and method of mining mineral formations, and especially coal formations, wherein the frictional engagement of the cutter type bits used to fracture the formations is reduced.

It is a still further object of the present invention to provide a method and apparatus for mining mineral formations, and especially coal formations, to reduce the sparking that may occur when the cutter bits are driven through the formation to be reduced.

BRIEF SUMMARY OF THE INVENTION

The present invention relates to new method and improved apparatus for excavating earth material, especially coal formations. It is believed that the invention will be specifically applicable to the mining of coal formations when using bits already used in the industry, and especially when using cutter bits known in the art as the pick type cutter bits and when using the new type cutter bit disclosed herein.

According to the present invention, a new method of mining mineral formations, such as coal, is contemplated which comprises the steps of driving the rotatable structural member in one direction of rotation about its longitudinal axis, engaging the coal formation with freely rotatable cutter support assemblies mounted on said structural member and feeding the power driven drum assembly toward the formation so that the engagement with the coal formation will impact the cutter bits into the coal and then drive the cutter support assemblies in a reverse direction than that of the structural member, allowing the cutter bits that have impacted to rotate away from the coal formation.

It is contemplated that this way of reducing a coal formation will minimize the dust and sparks that normally occur in mining, especially in mining coal formations.

Further according to the present invention, an improved excavating machine is contemplated, especially for mining coal formations, and comprises a movable support frame having a power drive mechanism mounted thereon. A rotatable structural member, which may be a large drum, is mounted on said movable frame and adapted to be driven in rotation by the power drive mechanism also mounted on the movable frame. A rotatable cutter support assembly is mounted on said structural member so that it is freely rotatable around its longitudinal axis and will be able to rotate in a direction in relation to the rotatable structural member.

Cutter bits, for example, the individually rotatable pick type bits, are mounted on the longitudinal periphery of the drum assembly for engagement with a coal formation.

A nonrotatable type cutter bit may also be used with the new apparatus. It is believed that the best nonrotatable type bit would be one comprising a wide, relatively flat forward working portion that is thin in cross section and whose foremost face is preferably curved rearwardly when viewed in side and all faces of the forward working portion diverse as they extend rearwardly of the forward working portion.

When the movable frame is positioned so that the cutter bits will engage the coal, the rotatable structure is driven in one direction of rotation about its longitudinal axis. This action causes the cutter bits, either the freely rotatable point attack type bits, or the sharp edges nonrotatable type bits, to impact and penetrate the coal formation with their forward working portions; however, the resistive force from the coal formation then causes the cutter support assembly to rotate about its longitudinal axis in the reverse direction from that of the power driven rotatable structural member.

The movable frame may be moved so as to apply pressure for impact force and also to move the drum assembly back and forth over the face of the coal seam or mineral deposit to be reduced.

The present invention also contemplates a method of making a head assembly to go on machines for reducing coal formations and which comprises the steps of fabricating a structural member so as to be mounted on a movable frame and driven in rotation about its longitudinal axis, mounting a cutter support assembly with cutter bits mounted thereon on said structural member so that it has free rotation about its longitudinal axis in relation to the structural member, and when the structural member is driven in rotation about one direction around its longitudinal axis, the cutter support assembly is allowed to rotate in a reverse direction about its own longitudinal axis in relation to the structural member.

The present invention also contemplates a new cutter head for a mining machine which comprises a structural member adapted to be driven in rotation about its longitudinal axis and a cutter support assembly mounted on the structural member and has cutter bits mounted on the longitudinal periphery of the drum assembly for engagement with mineral and other formations, such as coal and the like.

The present invention also contemplates a new cutter support assembly for coal mining which comprises a cutter support member having an internal bore and bearing means in said internal bore adapted to allow free rotation of a cutter support member on a bearing surface and cutter bits mounted on said cutter support member.

The present invention also contemplates the method of making a cutter support assembly for a cutter head for a coal mining machine and comprises the steps of fabricating a cutter support member and providing the cutter support member with an internal bore and providing the internal bore with bearing means to allow free rotation of a cutter support member upon a bearing surface.

It is believed that the above invention will be especially useful in reducing coal formations, and should eliminate much of the frictional contact now occurring when reducing coal formations. The dust and sparks which can be generated in mining coal should be minimized.

Along with the above benefits, it is believed that the horsepower requirement of the mining machines could be decreased per ton of coal mined. The mining of coal presently consists of impacting the coal seam with the tip of a cutter bit, thereby fracturing the coal formation, and then driving the bit on through the formation in the same direction. The bit is mounted on a drum assembly and encounters further frictional engagement with the coal as it is being driven on the drum. This invention is based on the concept that the driving of the cutter bits through the formation may not be necessary. It is believed the provision of a freely rotatable cutter support assembly that rotates in a direction opposite from that of the power driven structural member will accomplish the necessary impact on a coal seam in order to fracture it.

The exact nature of the present invention will become more clearly apparent upon reference to the following detailed specification taken in connection with the accompanying drawings in which.

Figure 8:
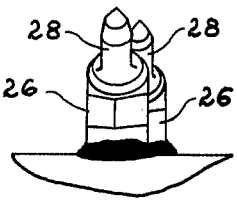
Figure 9:
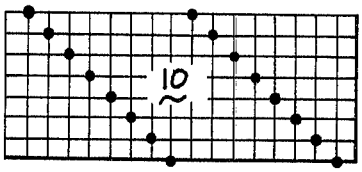

FIGS. 8 and 9 indicate a type of lacing pattern that can be used with the present invention.

Figure 10:
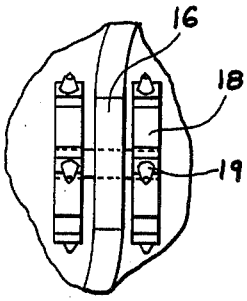
Figure 11:
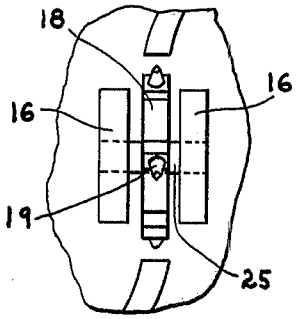

FIGS. 10 and 11 are modifications of a cutter support assembly according to the present invention.

DETAILED DESCRIPTION OF THE INVENTION

Figure 1:
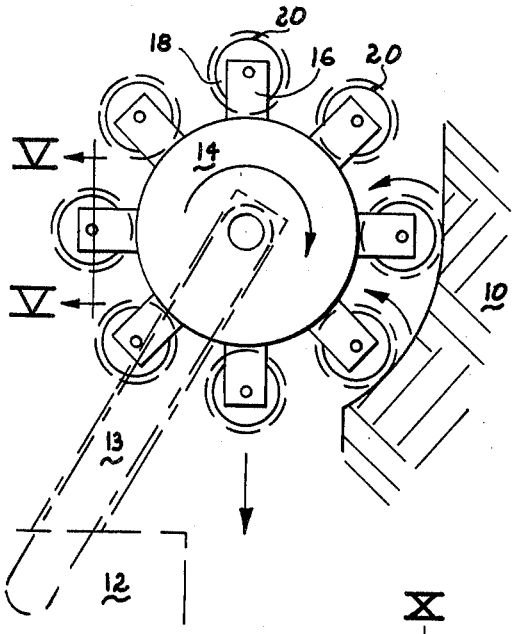
FIG. 1 is a side view of an improved machine performing the method according to the present invention.

Referring to the drawings somewhat more in detail, disclosed in FIG. 1 is a mineral formation shown at 10 that is to be mined or otherwise reduced. Preferably, the mineral formation 10 is a coal formation. Engaging the coal formation 10 is an apparatus having a movable frame 12 and a rotatable structural element 14. Rotatable structural member 14 is rotatably mounted on movable frame means 12 and a power drive means 13 drives structural element 14 in rotation in a clockwise direction as shown by the arrow.

The rotatable structural element may be a drum or other similar piece of equipment used on most machines, and around the outer periphery of the drum, or equidistant from a center line of the structural elements, are located support posts 16 which are welded and solidly connected to structural member 14. Support posts 16 are used to mount the rotatable cutter support assemblies 18.

Cutter support members 18 are freely rotatable about their axial center line and may be supported by having a support post 16 at each axial end of cutter support member 18. Mounted on the outer periphery of the cutter support member 18 are cutter bits 20 that actually engage the coal formation 10 in order to reduce it.

The pick type bits 20 are releasably held in the periphery of the freely rotatable member 18 such that the bits 20 are inclined torward a first direction of rotation about the longitudinal axis of said freely rotatable member. During operation, the pick type bits 20 impactively engage the coal formation 10 and the friction of said pick type bits' 20 engagement with the formation drives the freely rotatable support member 18 in a second direction of rotation opposite to the first direction of rotation.

Figure 4:
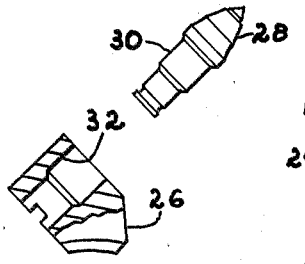
FIG. 4 is a view IV—IV on FIG. 3.
Figure 6:
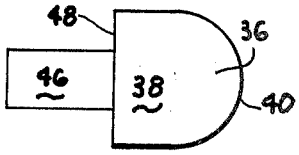
FIG. 6 is a side view of a nonrotatable bit according to the present invention.

Upon engagement of cutter bits 20, with the coal formation 10, the cutter support member 18 actually rotates in a direction opposite to that of the power driven rotatable structural element 14. Cutter bits 20 could take almost any form; however, the embodiments shown in FIGS. 4 and 6 are thought to be the preferable type of cutter elements to be used with the present invention.

Figure 2:
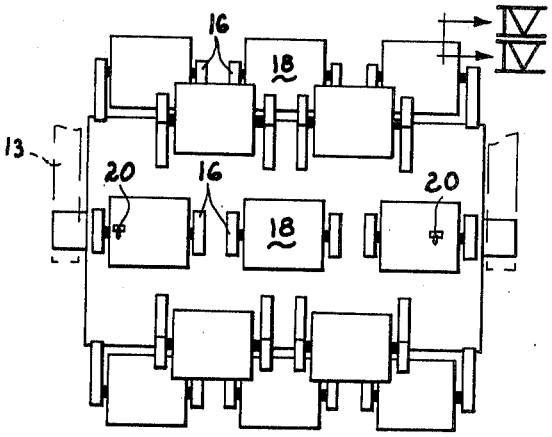
FIG. 2 is a top view of an improved machine according to the present invention.

Shown in FIG. 2 is a top view of what is shown in FIG. 1 with a movable frame means 12 driving the structural element 14 in rotation. Mounted at various places over the outer periphery of the rotatable structural element 14 are support posts 16 and these are shown supporting the rotatable cutter support members 18.

The rotatable cutter support members 18 should be distributed around the periphery so that the cutter bits 20 form any of the known and desired lacing patterns so as to reduce the coal formation. Again, the rotatable cutter support members 18 should be located so that they are freely rotatable and equidistant from a common axis.

Figure 3:
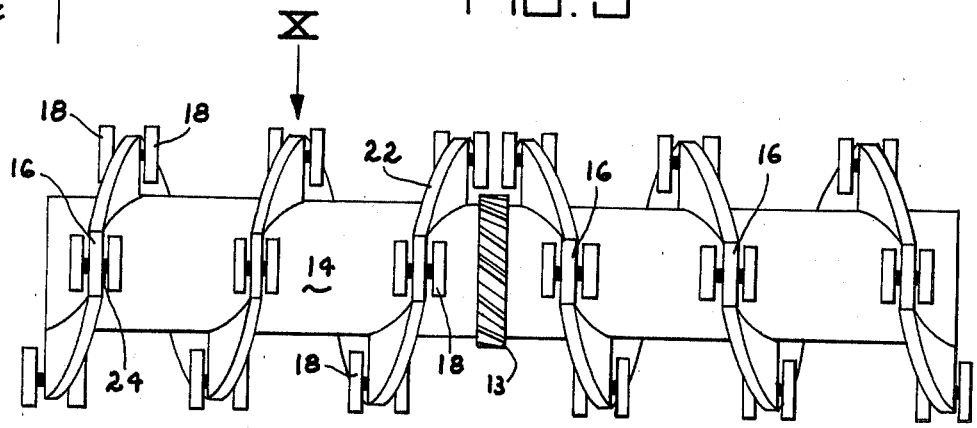
FIG. 3 is another embodiment of an improved machine according to the present invention.

Referring now to FIG. 3, what is shown therein is a modified drum of a common mining machine. In the present application, movable frame means is not shown; however, a power drive means 13 is shown attached around the center of the boom or rotatable structural member 14.

Substantially spiralling rib 22 is usually found on the boom or drum 14 and this spiralling rib has been modified by placing support posts 16 at various locations on the spiralling rib 22. On each side of the support posts 16, rotatable cutter suppor assemblies 18 are mounted and are freely rotatable around shaft 24, which is shown connecting them through support posts 16.

Shaft 24 will fit through support posts 16 and may have a sleeve for a bearing so that both cutter support assemblies 18 may freely rotate in unison with one another on support posts 16. Cutter bits are, of course, mounted on cutter support members 18, and when the rotatable structural member 14 is driven in rotation, while the cutter bits are engaging the coal formation, the cutter support members 18 will rotate in a direction opposite to that of structural member 14.

Shown in FIG. 4 is a typical tool holder 26 having a pick type bit 28. The shank 30 of the bit 28 can be inserted into the bore 32 of support block 26 and releasably held in the block. The block assembly may be fastened on a rotatable cutter support member 18 in any desired pattern.

Figure 5:
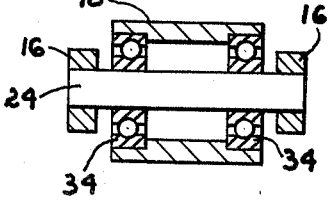
FIG. 5 is a sectional view of a cutter support assembly according to the present invention.

Referring now to FIG. 5, what is shown therein is a shaft 24 which is extending through a support member 16, shaft 24 having an either end rotatable cutter support members 18. In FIG. 5, bearing 34 is shown mounted in support member 16 in supporting shaft 24. As mentioned earlier, all that is needed is a bearing means to support the shaft rotatably in support member 16, bearing means being either an anti-friction bearing or, perhaps, a sleeve member mounted in 16 around shaft 24.

Figure 7:
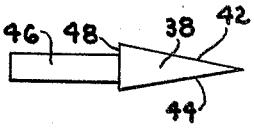
FIG. 7 is a front view of a nonrotatable bit according to the present invention.

Shown in FIGS. 6 and 7 is a new pick type bit 36 contemplated by the present invention which has a generally flat forward working portion 38 which is comprised of a hard wear resistant material. The forward working portion 38 has an arcuate, sharp forward edge 40 used for engaging and fracturing the coal. Two faces 42 and 44 diverge rearwardly from the arcuate portion as the faces 42 and 44 extend rearwardly from the edge.

The cutter bit 36 has a rearward shank portion 46 which is releasably inserted in a tool holder which may be mounted upon a rotatable cutter support assembly. The bit 46 has an abutment shoulder 48 formed at the juncture of the shank 46 with the forward working portion 38. The abutment shoulder 48 will preferably abut the forward face of the support block.

Shown in FIGS. 8 and 9 is a typical lacing pattern that may be found on a drum according to the present invention. Some sort of lacing pattern must be formed so that each and every section of the coal on the face will be fractured by a pick on the rotatable cutter support assembly.

In FIG. 8, shown on a rotatable cutter support assembly is a typical pick type bit 28 with holder 26 supporting the bit 28. It is possible, by either staggering the bits on the cutter support assembly or staggering the cutter support assembly, that a lacing pattern as is shown in FIG. 9 will be formed across the coal face so that all the faces of the coal are impacted at regular intervals by the bits.

Shown in FIGS. 10 and 11 are further examples of support posts 16 supporting a rotatable cutter support 18 having cutter bits 19 thereon. Shown in FIG. 11 is two cutter support posts 16, each supporting one end of a shaft 25 upon which a rotatable cutter support member 18 is mounted. Cutter support member 18 is shown with cutter bits 19 installed thereon.

Modifications may be made within the scope of the appended claims.

What is claimed is:

1. A method of reducing coal formations utilizing elongate pick type mining bits having an attack point at one end, wherein said method comprises the steps of: mounting in a readily releasable manner said pick type mining bits on the periphery of a support member which is freely rotatable through 360 degrees about an axis; inclining said bits toward a first direction of rotation with respect to said axis; and translating said releasably mounted bits across the formation to be reduced in a direction transverse to said axis; impacting the formation with said bits, thereby causing a frictional force to act upon said bits; and then rotating due to said frictional force said freely rotatable support member in a second direction of rotation about said axis opposite to said first direction of rotation.

2. A method of reducing coal formations according to claim 1 further comprising the step of: mounting said freely rotatable support members on the periphery of a power driven member.

3. A method of reducing coal formations according to claim 1 further comprising the step of: providing an assembly of individually and freely rotatable support members positioned around and equidistantly spaced from a common axis.

4. A method of reducing coal formations according to claim 1 further comprising the step of: joining to said periphery of said support member means for releasably fixing said bits to said support member.

5. A method of reducing coal formations according to claim 1 further comprising the steps of: forming said attack point on said bit with a conical configuration from a hard wear resistant material and forming a shank portion, at the end of the bit opposite to the end having the attack point, out of a material which is softer than the material comprising the attack point.

6. A mining machine, especially for mining coal formations, comprising: elongate pick type mining bits having an attack point at one end; a support member freely rotatable through 360 degrees about an axis; means for releasably securing said pick type bit to the periphery of said freely rotatable member such that said bits are inclined toward a first direction of rotation with respect to said axis; said means for releasably securing joined to and distributed over the periphery of said freely rotatable support member; said pick type bits releasably secured in said means for releasably securing; means for securing said freely rotatable member in a freely rotatable manner to a power driven member capable of translating said support member in a direction transverse to said axis; operating said machine in a manner that said pick type bits impactively engage said coal formation and the friction of said pick type bit's engagement with said coal formation drives the freely rotatable support member in a second direction of rotation about said axis opposite to said first direction of rotation.

7. A mining machine according to claim 6 wherein said power driven member comprises a power driven drum and said freely rotatable support members are positioned around and equidistantly spaced from a common axis about which said drum is rotated.

8. A mining machine according to claim 6 wherein said attack point on said bit has a conical configuration and is formed of a hard wear resistant material; and said bit further comprises a shank portion at the end of the bit opposite to the end having the attack point, and formed of a material softer than the material forming the attack point.

9. A mining machine according to claim 6 wherein said means for releasable securing said bit has means for allowing free rotation of said bit about the longitudinal axis of said bit.

* * * * *